US010273762B2

(12) United States Patent
Stachowiak et al.

(10) Patent No.: US 10,273,762 B2
(45) Date of Patent: Apr. 30, 2019

(54) ON-OFF TOOL FOR SUCKER ROD STRING

(71) Applicant: Weatherford Technology Holdings, LLC, Houston, TX (US)

(72) Inventors: John E. Stachowiak, Houston, TX (US); Brandon M. Page, Spring, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 475 days.

(21) Appl. No.: 14/946,898

(22) Filed: Nov. 20, 2015

(65) Prior Publication Data

US 2016/0208564 A1 Jul. 21, 2016

Related U.S. Application Data

(60) Provisional application No. 62/082,913, filed on Nov. 21, 2014.

(51) Int. Cl.
*E21B 17/046* (2006.01)
*E21B 17/10* (2006.01)

(52) U.S. Cl.
CPC ..... *E21B 17/046* (2013.01); *E21B 17/1071* (2013.01)

(58) Field of Classification Search
CPC ..... E21B 17/021; E21B 17/046; E21B 17/06; E21B 17/1071; Y10T 403/599
See application file for complete search history.

(56) References Cited

U.S. PATENT DOCUMENTS 1,645,428 A * 10/1927 Hosmer ..... E21B 17/046 279/100
2,161,501 A * 6/1939 Blackmon ..... E21B 17/046 403/328
2,671,682 A 3/1954 Page
2,921,364 A 11/1957 Bloudoff
3,366,408 A 1/1968 Scarborough et al.
3,455,248 A 7/1969 Sutton et al.
4,921,407 A * 5/1990 Ponder ..... E21B 17/06 417/553
9,784,055 B1 * 10/2017 Bair ..... E21B 19/24
(Continued)

OTHER PUBLICATIONS

Stachowiak, J. et al., "Presentation—On-Off tool," PowerPoint Presentation available from www.alrdc.com, copyright 2012.
(Continued)

*Primary Examiner* — Daniel P Stephenson
(74) *Attorney, Agent, or Firm* — Blank Rome, LLP

(57) ABSTRACT

An on-off tool for latching a sucker rod to a plunger rod has a housing, a pawl, guide pines, and a key. One end of the housing is connected to the sucker rod, and an interior of the housing defines a key slot terminating at a seat inside the interior. The pawl is disposed in the interior of the housing and is biased longitudinally preferably by disc springs. Bearings in the form of elongate pins are engaged between the pawl and the housing and dispose longitudinally in slots to guiding longitudinal movement of the pawl in the interior and preventing rotation of the pawl. The key has a head at its distal end that is passable through the key slot, interlockable with the pawl, and seatable on the seat. The key's head preferably defines a waist thereabout to provide the head with greater load bearing surface to engage the housing's seat.

25 Claims, 11 Drawing Sheets

(56) References Cited

U.S. PATENT DOCUMENTS

| | | | | |
|---|---|---|---|---|
| 2013/0140029 | A1* | 6/2013 | Sullivan | E21B 17/021 166/305.1 |
| 2014/0110130 | A1 | 4/2014 | Lembcke | |
| 2016/0208564 | A1* | 7/2016 | Stachowiak | E21B 17/046 |
| 2017/0248245 | A1* | 8/2017 | Ford | E21B 43/127 |

OTHER PUBLICATIONS

Western Oilfield Specialties Corp., "Browning On-Off Tool," Brochure, undated, obtained from www.weasteroilfieldspecialties.com on Aug. 29, 2014.

Western Oilfield Specialties Corp., "The Browning On-Off Tool: Automatic Latch On and Off Tool," Brochure, undated, obtained from www.weasteroilfieldspecialties.com on Aug. 29, 2014.

Harbison-Fisher, "Rod Pumps for High-Volume Fluid Production," Product Brochure, undated, obtained from www.red-adesigngroup.com on Sep. 30, 2014.

Roderick, R. et al., "Uses, Operation, Design Considerations and Load Rating of On-Off Tool," Apr. 2011.

Don-Nan Pump & Supply, "On-Off Tool," Product Brochure, undated, obtained from www.don-nan.com on Aug. 29, 2014.

Weatherford, "On-Off Tool," Product Brochure, copyright 2012.

Office Action in counterpart CA appl. 2912508, dated Oct. 11, 2016, 3-pgs.

* cited by examiner

ON-OFF TOOL FOR SUCKER ROD STRING

CROSS-REFERENCE TO RELATED APPLICATIONS

This application claims the benefit of U.S. Provisional Appl. 62/082,913, filed 21 Nov. 2014, which is incorporated herein by reference.

BACKGROUND OF THE DISCLOSURE

A conventional oil well includes a cased wellbore with at least one string of tubing extending downwardly through the casing into the oil or other petroleum fluid contained in the subsurface mineral formation to be produced. The casing is perforated at the level of the production zone to permit fluid flow from the formation into the casing, and the lower end of the tubing string is generally open to provide entry for the fluid in the tubing.

Many hydrocarbon wells are unable to produce at commercially viable levels without assistance in lifting the formation fluids to the earth's surface. In some instances, high fluid viscosity inhibits fluid flow to the surface. More commonly, formation pressure is inadequate to drive fluids upward in the wellbore. In the case of deeper wells, extraordinary hydrostatic head acts downwardly against the formation and inhibits the unassisted flow of production fluid to the surface.

In many instances, artificial lift may be required to raise the produced fluids to the surface. A common approach for urging production fluids to the surface uses a mechanically actuated, positive displacement pump driven from the surface by a pumpjack connected to the pump by a sucker rod string. Reciprocal movement of the sucker rod string induces reciprocal movement of the pump for lifting production fluid to the surface.

For example, a reciprocating rod lift system 20 of the prior art is shown in FIG. 1A to produce production fluid from a wellbore 10. As is typical, surface casing 12 hangs from the surface and has a liner casing 14 hung therefrom by a liner hanger 16. Production fluid F from the formation 11 outside the cement 13 can enter the liner 14 through perforations 17. To convey the fluid, production tubing 26 extends from a wellhead 28 downhole, and a packer 15 seals the annulus between the production tubing 26 and the liner 14. At the surface, the wellhead 28 receives production fluid and diverts it to a flow line 29.

The production fluid F may not produce naturally to reach the surface so operators use the reciprocating rod lift system 20 to lift the fluid F. The system 20 has a surface pumping unit 22, a sucker rod string 24, and a downhole rod pump 30. The surface pumping unit 22 reciprocates the rod string 24, and the reciprocating string 24 operates the downhole rod pump 30. The rod pump 30 has internal components attached to the rod string 24 and has external components positioned in a pump-seating nipple 31 near the producing zone and the perforations 17.

As best shown in the detail of FIG. 1B, the rod pump 30 has a barrel 40 with a plunger 32 movably disposed therein. The plunger 32 has a plunger rod 33 attached to it, which connects to the rod string (24; FIG. 1A) of the reciprocating rod lift system 20. The plunger rod 33 is of sufficient length so that the plunger rod 33 will extend through the upper end of the barrel 40 even at the bottom of the plunger's stroke.

The barrel 40 has a standing valve 42, and the plunger 32 has a traveling valve 34. For example, the standing valve 42 disposed in the barrel 40 can be a check valve having a ball 44 and seat 46. Similarly, the traveling valve 34 can also be a check valve (i.e., one-way valve) having a ball 36 and seat 38. For its part, As the surface pumping unit 22 in FIG. 1A reciprocates, the rod string 24 reciprocates in the production tubing 26 and moves the plunger 32. The plunger 32 moves the traveling valve 34 in reciprocating upstrokes and downstroke. During an upstroke, the traveling valve 34 as shown in FIG. 1B is closed (i.e., the upper ball 36 seats on upper seat 38). In many instances, the force acting on the plunger 32 through the sucker rod string 24 may exceed 100,000 pounds.

Movement of the closed traveling valve 34 upward reduces the static pressure within the pump chamber 45*b* (the volume between the standing valve 42 and the traveling valve 32 that serves as a path of fluid transfer during the pumping operation). This, in turn, causes the standing valve 42 to unseat so that the lower ball 44 lifts off the lower seat 46. Production fluid F is then drawn upward into the chamber 45*b*.

Ultimately, the produced fluid F is delivered by positive displacement of the plunger 32, out passages 45*a* in the barrel 40. The moved fluid then moves up the wellbore 10 through the tubing 26 as shown in FIG. 1A.

On the following downstroke, the plunger 32 moves downward in barrel 40 by the reciprocation applied by the pumping unit 22 via the sucker rod string 24. The weight of the sucker rod string 24 pushes the plunger 32 through the fluid in the barrel 40. The standing valve 42 closes as the standing ball 44 seats upon the lower seat 46. At the same time, the traveling valve 34 opens so fluids previously residing in the chamber 45*b* can pass through the valve 34 and into the plunger 32. The upstroke and down stroke cycles are repeated, causing fluids to be lifted upward through the wellbore 10 and ultimately to the earth's surface.

At some point, it may become necessary to disconnect or connect the sucker rod string 24 with the pump 30, such as in an oversize tubing pump installation where the pump plunger 32 is installed separately from the sucker rod string 24. In an insert pump or a standard tubing pump 30, the plunger 32 or other portions of the pump 30 may become sanded in, corroded, or otherwise difficult to remove from the wellbore 10. Typically, the sucker rod string 24 is not robust enough to transmit the necessary force required to remove stuck components without damaging the sucker rod string 24 for later use. In other instances, it may be desirable the remove only the sucker rod string 24 simply to adjust and maintain the sucker rod string 24 without removing either the plunger 32 or the entire barrel pump 40.

For these reasons, it may be desirable to use a disconnect device or on-off tool 50 on the sucker rod string 24, as shown in FIGS. 1A-1B. The on-off tool 50 must be able to disconnect the sucker rod string 24 at the desired location, but must also be able to be reconnected as desired by the operators. Usually, the on-off tool 50 is installed on the sucker rod string 24 close to the plunger 32.

To connect the sucker rod string 24 to the pump 30 disposed downhole, the on-off tool 50 latches automatically to the pump 30 as the sucker rod string 24 is lowered. The on-off tool 50 then rotates to the correct alignment position and uses the sucker rod string's weight to complete the latching. To disconnect the sucker rod string 24 from the pump 30, the on-off tool 50 releases or unlatches by simply setting the pump 30 at the bottom of its stroke and turning the rod string 24 in the release direction of the tool 50 while slowly picking up the rod string 24. The on-off tool 50 can have either right-release or left-release direction based on the application and other equipment used.

A number of on-off tools 50 are available to connect/disconnect the sucker rod string 24 to the pump 30. For example, FIGS. 2 and 3 depict prior art sucker rod disconnects or on-off tools 50 for use on a reciprocating sucker rod string.

The on-off tool 50 of FIG. 2 is an example of a conventional on-off tool similar to that disclosed in U.S. Pat. No. 3,366,408. The tool 50 includes a housing 52 having a top fitting 54 with a pin connector for attaching to a sucker rod (24) with a coupling (25). Contained inside the housing 52, a pawl 58 can move axially/longitudinally against the bias of one or more springs 56. Spherical bearings 59*a* on the pawl 58 keep it from rotating as the bearings 59*a* ride in channels inside the housing 52. Opposite the housing 52, the tool 50 includes a key 70 having a head 72 at its distal end and connecting at its proximal end 74 with a box connector to the plunger rod (33) of a pump (30).

Connection is made when the housing 52 is lowered onto the key 70 so that the housing 52 interfits and interlocks with the key 70. The connection is accomplished by the weight of the sucker rod string (24) above the housing 52, by a rotation of the rod string (24) that causes relative rotary motion between the housing 52 and the key 70, and by the latching action of the key's head 72 to the internal mechanism of the tool 50.

In particular, the key 70 inserts in a key slot 60 in the housing 52 so the key 70 in a locked position can engage a seat or ledge 62 and transmit the tensile forces exerted by the pumpjack (22) on the up stroke. A spiral profile 64 in the housing 52 can help orient the insertion of the key's head 72 through the slot 60. The key's proximal end 74 cooperates with the distal end of the housing 52 to transmit any compressive forces of the tool 50 to the plunger rod (33) and ultimately the plunger (32).

The key 70 is typically inserted into the key slot 60 where the key 70 acts upon the pawl 58 to compress the spring 56. The key 70 is then rotated, typically about 90 degrees, allowing the spring 56 to extend and the pawl 58 to lower onto the key head (72), which places the key 70 into a locked position. The pawl 58 and the spring 56 then act upon the key 70 to prevent the key 70 from returning to the unlocked position until the operator desires to disconnect the sucker rod string (24) at the location of the tool 50. In use then, the key 70, pawl 58, and other components of the tool 50 allow the operator to disconnect the sucker rod string (24) or to reconnect the sucker rod string (24) to the pump (30), as desired.

Another on-off tool 50 according to the prior art shown in the cross-sectional view of FIG. 3 also includes a housing 52 with a top fitting 54 for attaching to a sucker rod string (24) using a coupling (25). A pawl 58 in the housing 52 can move longitudinally against the bias of one or more springs 56*a-b*. Rather than using spherical bearings, fixed pins 59*b* on the housing 52 can ride in slots in the pawl 58 to keep the pawl 58 from rotating inside the housing 52. Opposite the housing 52, the tool 50 similarly includes a key 70 having a head 72 at its distal end and connecting at its proximal end 74 to the plunger rod (33) of a pump (30).

Operation of this on-off tool 50 is similar to that discussed previously. In particular, FIGS. 4A-4D show the on-off tool 50 of FIG. 3 during stages of coupling. Initially, the key 70 is coupled to the plunger rod 33 of the pump (30) disposed downhole in the production tubing (14). The housing 52 is connected to the sucker rod string (24) using the coupling 25 and is lowered down the tubing string to the pump (30). Eventually, the housing 52 inserts over the key 70, which passes through the slot 60 in the housing 52.

The head 72 of the key 70 has an oblong cross-section. If the key 70 is not properly aligned with the opening for the slot 60, then relative rotation between the housing 52 and key 70 can align the head 72 with the slot 60. Passing up through the housing 52, the key 70 pushes the pawl 58 against the bias of the spring 56*a-b*, as shown in FIG. 4B.

The on-off tool 50 incorporates a cam-type system using the internal pawl 58 under the spring's force and being actuated (in a longitudinal direction) by rotating relative to the key 70. This imparts torque, which requires the guide pins 59*b* to counteract the torque and to keep the pawl 58 from rotating in the housing 52.

To complete the latching, the sucker rod (24) is rotated to rotate the housing 52. As shown, the bottom of the housing 52 can have a clutch shoulder to engage a tab or the like on the key 70 to indicate sufficient rotation. The pawl 58 turns with the housing 52 until a pocket in the pawl 58 aligns with the oblong head 72, and the springs 56*a-b* then push the pawl 58 over the head 72. Reciprocating of the sucker rod (24) can now operate the pump (30) while the on-off tool 50 holds the sucker rod string (24) to the plunger rod (33).

Primarily, current on-off tools as disclosed above have a small radius and contact surfaces underneath the key's head 72 for engaging the seat 62 of the housing 52. For example, FIGS. 5A-1 and 5A-2 illustrate perspective views of the key head 72 according to the prior art, FIG. 5B shows the key's head 72 of the prior art seated in the housing's seat 62, and FIG. 5C illustrates a diagram of the load bearing areas of the prior art key head 72.

FIG. 5D illustrates the geometry of the key's head 72 of the prior art. The head's outline 79 is relatively oval with long sides L and short sides W. Each edge of the short sides W is fully defined by a full radius r. This shape corresponds roughly to the shape of the key slot 60 of the housing 52, which can be readily formed by milling out material in the housing 52 with a drill bit having the proper radius r. By contrast, manufacture of the key's head 72 with this outline 79 is less straightforward and can require more careful machining.

The key 70 has a cylindrical stem 71 between the larger head 72 and proximal end 74. As noted previously, the head 72 has an oblong shape so it can insert into the slot 60. Therefore, the head 72 has thinned sides 73 where a bearing surface 75 of the head 72 is absent. As noted above, the key's head 72 inserts through the housing's slot 60, and relative rotation of about 90-degrees places the head's bearing surface 75 against the seat or ledge 62 inside the housing 52. Additionally, the side's of the pawl (58) fit over the head 72 on its thinned sides 73.

As can be seen, current on-off tools 50 as disclosed above utilize coil springs 56 to bias the pawl 58 toward the key head 72 to complete the latching sequence. These coil springs 56 fail to provide enough axial load needed to keep the tool 100 latched in higher speed pumping applications where the dynamics of the sucker rod string 24 can cause the key 70 to overcome the rotational torque needed to compress the coil spring 56, causing the tool 100 to unlatch.

Unfortunately, it is apparent that the on-off tools 50 currently used in the industry can be the weakest part of the sucker rod string 24, thereby becoming the point in the sucker rod string 24 most likely to fail. The currently used tool 50 becomes weaker over time due to the loading and unloading of the tool 50, which can experience loads in excess of 100,000 pounds several times each minute for months or even years.

In particular, as with all components in the reciprocating system, the on-off tool 50 is subject to axial fatigue, which limits its lifespan in certain operating conditions. Currently, such tools use point-loading, which is undesirable.

During use, for example, the key 70 is subjected to deformation due to downstroke and upstroke impacts. The housing's seat 62 deforms due to broaching of the key head 72, and the seating area 75 of the key head 72 deforms from impact wear on upstrokes. Likewise, the housing 52 is subjected to brinelling due to impact on upstrokes.

As wear increases, the gap or play between the housing's bottom shoulder 57 and the key's ledge 77 increases and produces a slide hammer effect. The increased play between the housing 52 and the key 70 further beats the seat 62 against the head's bearing surface 75. Eventually, the key head 72 can break off due to impacts. During high stroke speeds, the current on-off tool 50 can also become unlatched due to dynamic forces (axial loads and torque) imparted through the rod string 24 coupled with low spring force on the pawl 58.

Carpenter tool offers a cam-type on/off tool that incorporates a large radius underneath the key head to reduce the stress concentration. This helps somewhat, but fails to address the high bearing contact stresses underneath the head. Thus, a need exists for a sucker rod disconnect that allows the sucker rod string to be disconnected at a particular point but that may then be reconnected without the disconnect becoming the weakest point in the sucker rod assembly, and thereby becoming the most likely failure point in the sucker rod string. Additionally, what is needed is an on-off tool that does not unlatch unexpectedly during normal use.

The subject matter of the present disclosure is directed to overcoming, or at least reducing the effects of, one or more of the problems set forth above.

SUMMARY OF THE DISCLOSURE

According to the present disclosure, a tool for latching a sucker rod to a plunger includes a housing, a pawl, at least one bearing, and a key. The housing has first and seconds ends and defines an interior. The first end connects to the sucker rod. The interior defines a key slot at the second end of the housing, and the key slot terminates at a seat inside the interior. The pawl is disposed in the interior of the housing and is biased longitudinally therein away from the first end toward the seat. The at least one bearing is engaged between the pawl and the housing. The at least one bearing guides longitudinal movement of the pawl in the interior and prevents rotation of the pawl. The key has distal and proximal ends. The proximal end connects to the plunger. The distal end has a head passable through the key slot, interlockable with the pawl, and seatable on the seat.

In one aspect, the housing comprises at least one biasing element disposed in the interior and basing the pawl longitudinally therein away from the first end. The at least one biasing element can include a plurality of disc springs rather than a standard coil spring. The disc springs are expected to increase the bias force on the pawl by as much as 200% in some cases.

In another aspect that may be combined with any of the other aspects, the at least one bearing is an elongate pin. The pawl defines a longitudinal side pocket, and the housing defines a longitudinal slot. The elongate pin is disposed between the longitudinal side pocket and the longitudinal slot. At least two elongate pins can be used on opposing sides of the pawl.

In yet another aspect that may be combined with any of the other aspects, the head of the key defines a waist of increased dimension. This waist increases the lower contact area of the key's lower bearing surface that can engage on the slot's seat in the housing. The waist also allows the tip of the key to have thinned sides to engage in the pocket of the pawl without the need to change the overall dimension of the pawl.

The foregoing summary is not intended to summarize each potential embodiment or every aspect of the present disclosure.

BRIEF DESCRIPTION OF THE DRAWINGS

FIGS. 5A-1 and 5A-2 illustrate perspective views of the key head according to the prior art.

DETAILED DESCRIPTION OF THE DISCLOSURE

Figures 1A, 1B:
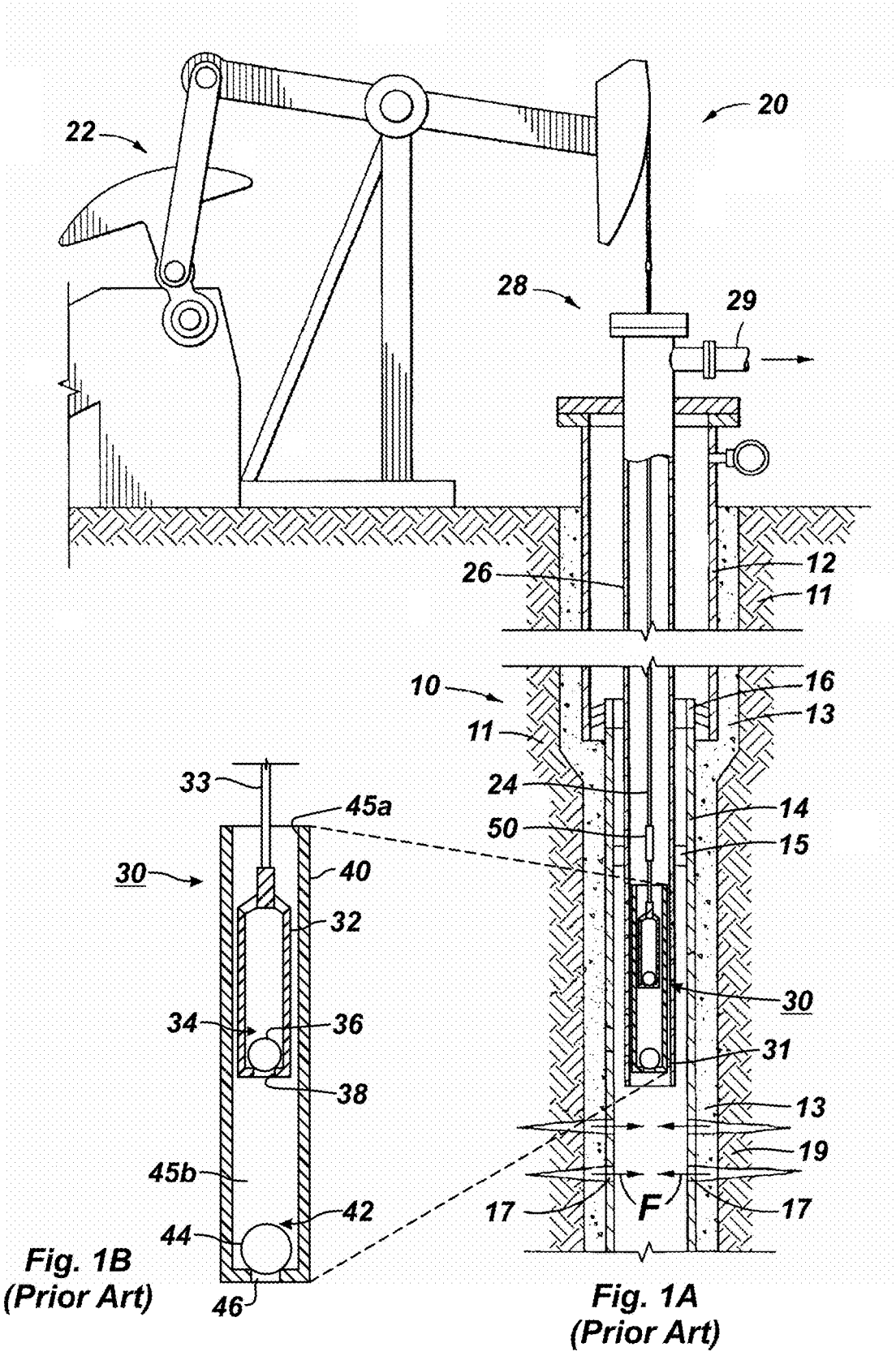
Fig. 1B (Prior Art)
Fig. 1A (Prior Art)
FIG. 1A illustrates a reciprocating rod lift system having a rod pump according to the prior art.
FIG. 1B illustrates a detailed cross-sectional view of the rod pump of FIG. 1A.
Figure 2:
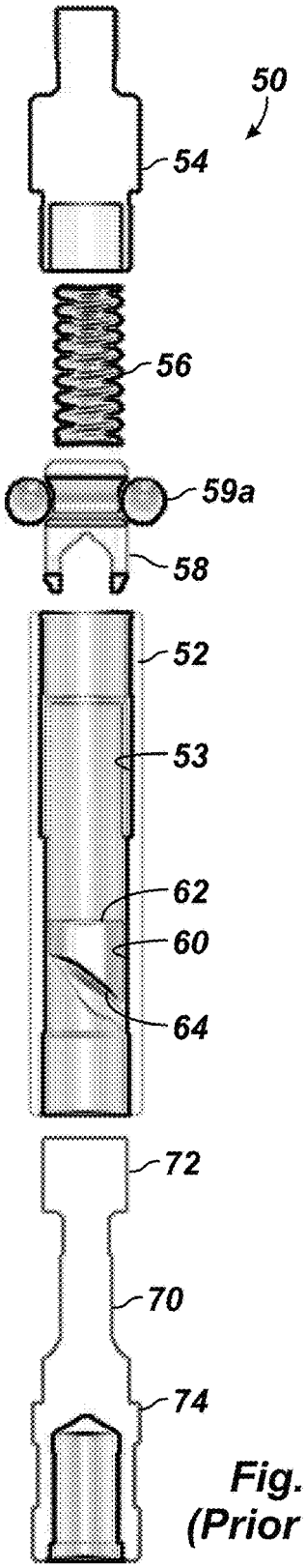
Fig. 2 (Prior Art)
FIG. 2 illustrates an on-off tool according to the prior art in an exploded cross-sectional view.
Figure 3:
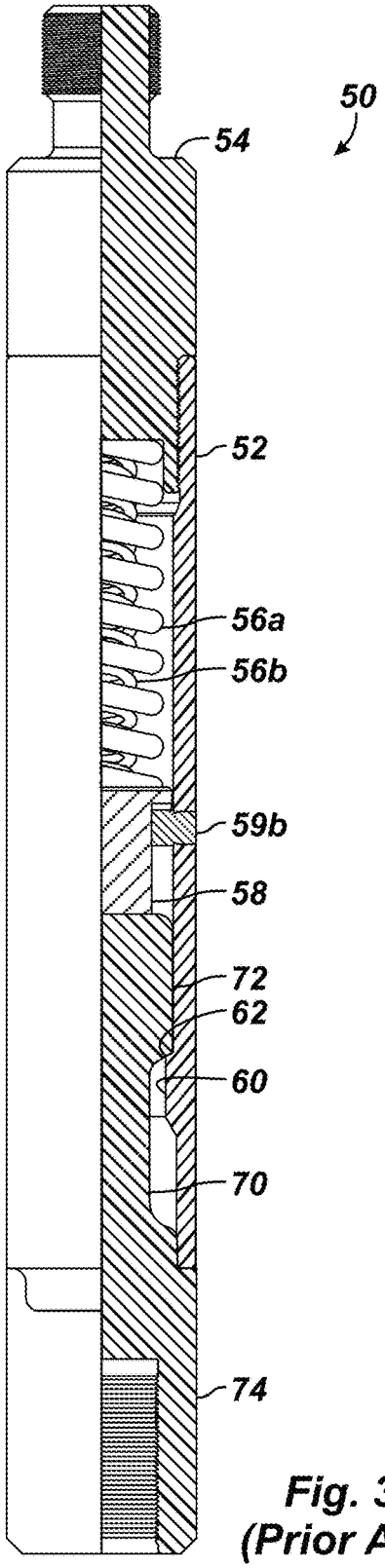
Fig. 3 (Prior Art)
FIG. 3 illustrates another on-off tool according to the prior art in an assembled cross-sectional view.
Figure 4A:
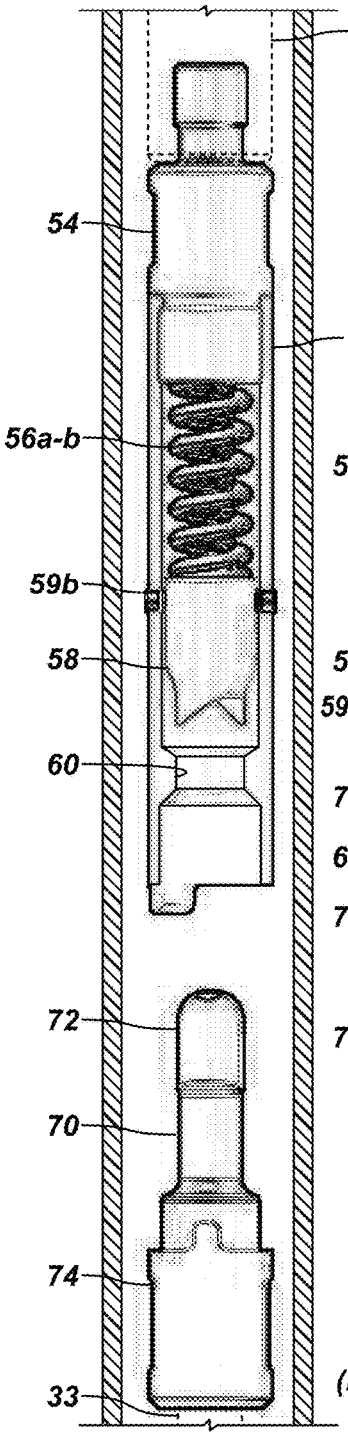
Fig. 4A (Prior Art)
FIGS. 4A-4D shows the on-off tool of FIG. 3 during stages of coupling.
Figure 4B:
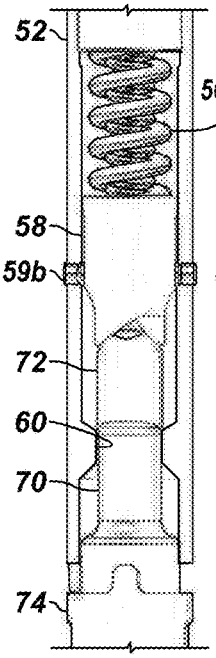
Fig. 4B (Prior Art)
Figure 4C:
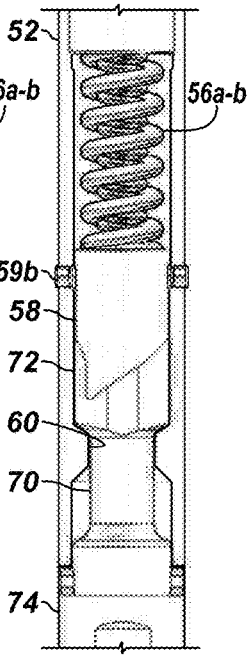
Fig. 4C (Prior Art)
Figure 4D:
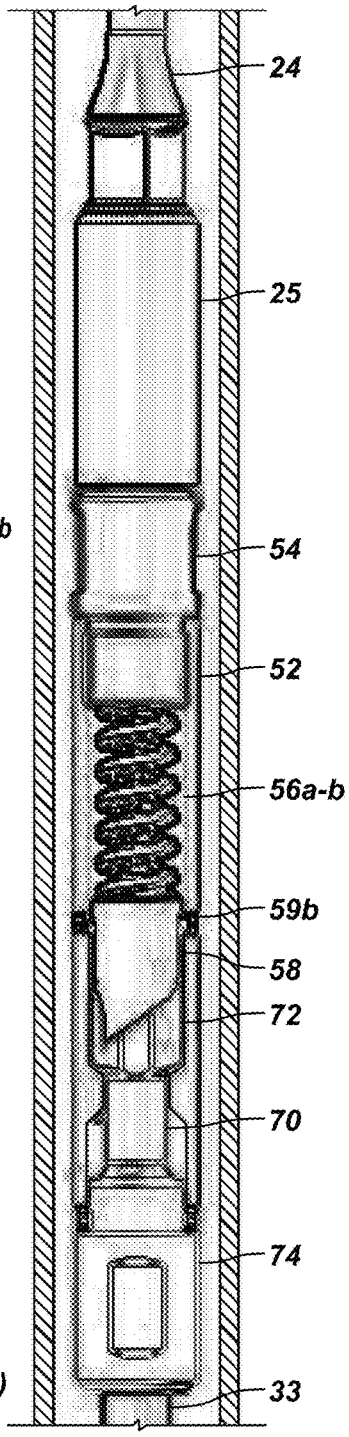
Fig. 4D (Prior Art)

FIGS. 6A-6D illustrate an on-off tool 100 according to the present disclosure in an elevational view, a first side cross-sectional view, a second side cross-sectional view, and an exploded view. The tool 100 can be used for latching a sucker rod string (24) to a plunger rod (33) of a pump (30) for an artificial lift system, such as discussed previously with reference to FIGS. 1A-1B. The tool 100 has a housing or body 110, an end fitting 120, one or more biasing members 130, a pawl 140, guide bearings 145, and a key 160. The bearings 145 are elongate pins disposed longitudinally between the pawl 140 and the housing's interior 112.

As with other types, the current on-off tool 100 connects at its end fitting 120 to a sucker rod string (24) with a coupling (25) and connects at its key 160 to the plunger rod (33) of a pump (30). As will be detailed below, latching and unlatching of the tool 100 is achieved through the engagement of the housing 110 and its components to the key 160.

The housing 110 has first and seconds ends 114, 116 and defines an interior 112. The first end 114 connects to the end fitting 120, which has a pin connector 122 for attaching to the sucker rod string (24) with a coupling (25). The interior 112 defines a key slot 150 at the second end 116 of the housing 110, and the key slot 150 terminates at a seat or lower ledge 155 inside the interior 112.

The second, distal end 116 of the housing 110 can have a clutch arrangement (not shown), such as discussed in the Background. Alternatively and as specifically shown, the end 116 can define a uniform shoulder for potential engagement with the base 164 of the key 160. This can have some advantages during latching and unlatching of the tool 100 as well as helping the tool 100 to handle wear and forces during latched operations.

The pawl 140 is disposed in the interior 112 of the housing 110 and is biased axially/longitudinally therein away from the first end 112 toward the seat 155. One or more biasing elements 130 force the pawl 140 toward the second end 116 of the housing 110. To guide axial/longitudinal movement of the pawl 140 in the interior 112, longitudinal pins 145 are engaged longitudinally between the pawl 140 and the housing's interior 112. These pins 145 also prevent rotation of the pawl 140 during the latching or unlatching sequence, as described later.

For its part, the key 160 has a proximal end 164, which typically connects to the pump's plunger rod (33) with a box connector 169. A stem 161 extends from the proximal end 164, and a distal end of the stem 161 has a head 162 that is passable through the key slot 150 on the tool's housing 110. When inserted through the key slot 150, the head 162 is interlockable with the pawl 140 and is seatable on the seat 155 to complete the latching between the housing 110 and key 160.

In use downhole, the key 160 is typically coupled to the plunger rod (33) of the pump (30) disposed downhole in the production tubing (14). At the surface, the housing 110 is then typically connected to the sucker rod string (24) using the coupling (25) and is lowered down the tubing (14) to the pump (30). Eventually, the housing 110 is lowered down relative to the key 160, as illustrated in FIGS. 7A-7D, so that the housing 110 and key 160 can latch together in a latching sequence.

Figure 7A:
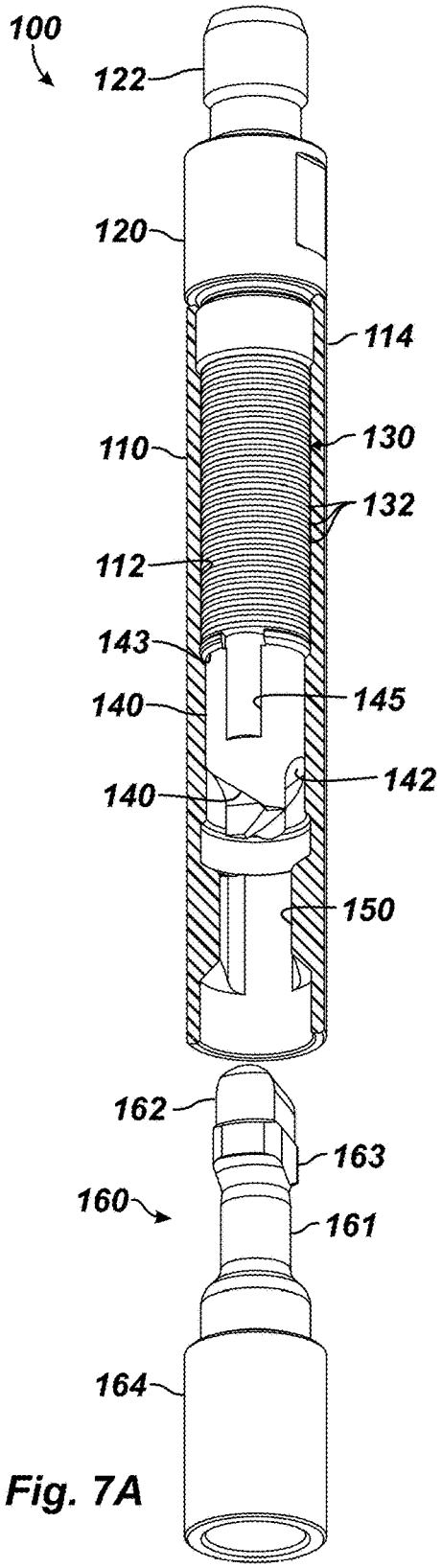
FIG. 7A illustrates a perspective view of a key before insertion into the disclosed tool's housing, which is shown in a cutaway to reveal internal features.
Figure 7B:
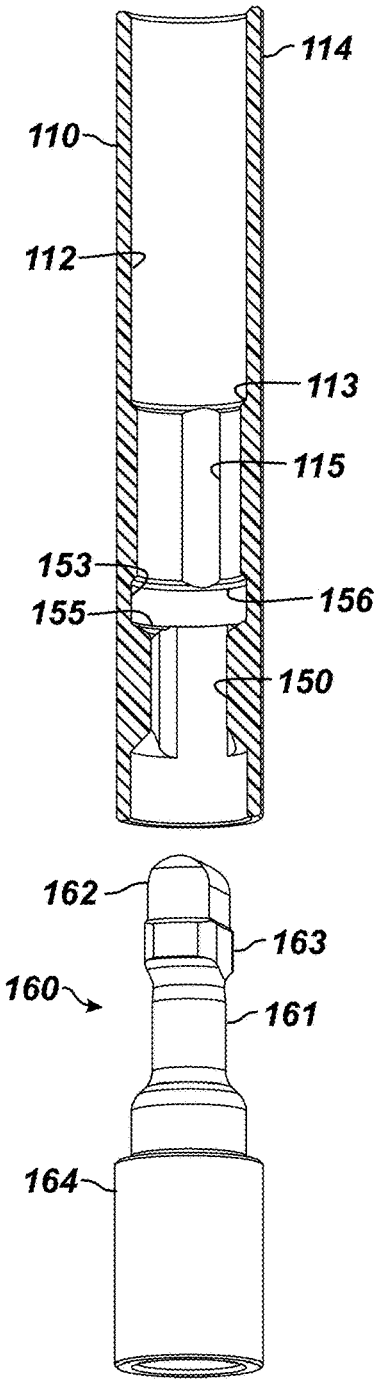
FIG. 7B illustrates another perspective view of the key relative to the disclosed tool's housing, which is shown in a cutaway without internal components.
Figure 7C:
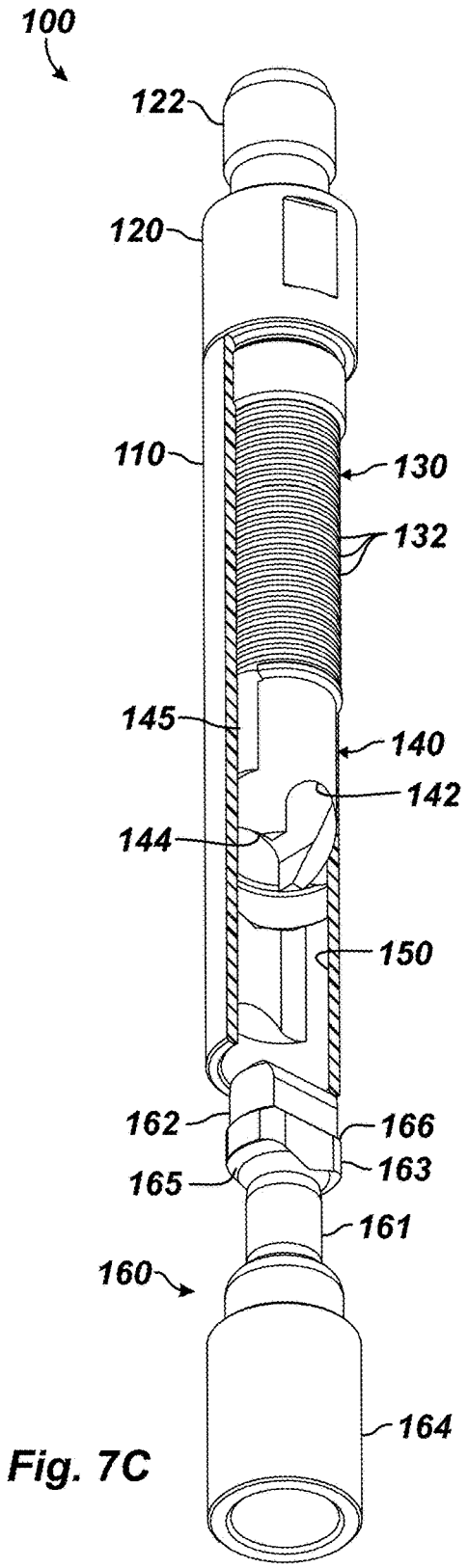
FIGS. 7C-7D illustrate additional perspective views of the key before insertion into the disclosed tool's housing, which is shown in cutaway along another side to reveal additional internal features.
Figure 7D:
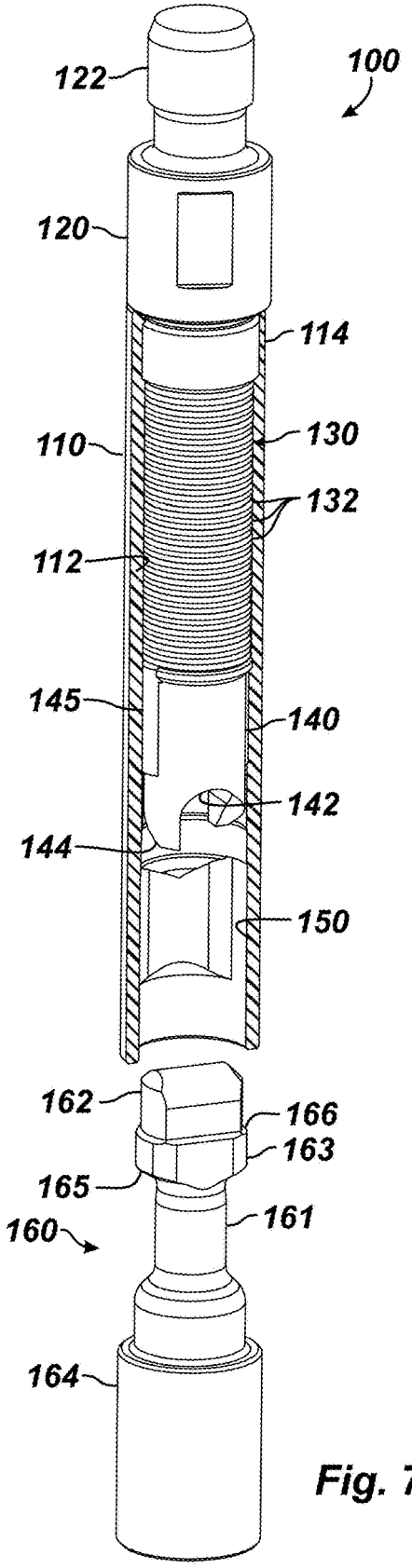

In particular, FIGS. 7A-7B illustrate perspective views of the key 160 before insertion into the tool's housing 110. To reveal internal features, the housing 110 is shown in a cutaway. Furthermore, the tool's housing 110 depicted in FIG. 7B is shown without internal components to reveal features of the housing's interior 112. Finally, FIGS. 7C-7D illustrate additional perspective views of the key 160 before insertion into the tool's housing 110, which is shown in cutaway along another side to reveal additional internal features from another perspective.

In this initial state of the latching sequence before the housing 110 inserts on the key 160, the pawl 140 is biased by the basing elements 130 to its lowermost position ready to eventually engage the key head 162 when inserted in the oblong key slot 150. The pawl's longitudinal pins 145 reside in the longitudinal slots 115 (best shown in FIG. 7B) in the housing's bore 112 and keep the pawl 140 from rotating. An inner ledge 143 on the upper end of the pawl 140 can engage an inner shoulder 113 in the housing's interior 112 to limit further movement of the pawl 140. Slanted forks 144 around the pawl's pocket 142 are aligned with the longitudinal pins 145 and with the long width of the key slot 150 in the housing 110.

Particular details of the key slot 150 are revealed in FIG. 7B. The key slot 150 defines an oblong keyway for passage of the head 162 and waist 163 of the key 160. The profile of the keyway of the slot 150 approximates the dimension of the waist 163, as disclosed herein. The upper end of the key slot 150 defines an expanded diameter headway 153 inside the housing's interior 112. This expanded diameter headway 153 can eventually accommodate an expanded waist 163 on the key head 162, as detailed below. The headway 153 defines a circular dimension inside the interior 112 of the housing 110 to accommodate rotation of the head 162 and waist 163 during coupling and uncoupling, as disclosed herein.

As shown, the seat 155 for the slot 150 is formed by a lower ledge at this expanded diameter headway 153 around the oblong key slot 150. As noted herein, this seat 155 will eventually engage a lower bearing surface 165 of the key head 162 once latching is complete.

As also shown, a stop 156 for the slot 150 may be formed by an upper ledge at the expanded diameter headway 153 inside the housing's interior 112. As discussed in more detail later, this stop 156 may eventually engage an upper surface 166 of the key head's waist 163 once latching is complete, although this is not strictly necessary.

Continuing with the latching sequence, the housing 110 is eventually lowered down onto the key 160 so latching between the housing 110 and the key 160 can be performed. To do this, the housing 110 inserts over the key 160, which passes through the oblong slot 150 in the housing 110. The head 162 of the key 160 with its oblong cross-section can align and pass up through the oblong slot 150. Eventually, the key 160 pushes the pawl 140 against the bias of the biasing element 130.

As the key head 162 engages the pawl 140, it pushes against the slanted forks 144. The key 160 is inserted fully. For example, the base 164 can shoulder with the housing's end 116, the upper surface 166 of the key's waist 163 can engage the stop 156 defined in the housing's interior 112, the biasing elements 130 can fully compress, and/or a central pin or lug (135) can stop movement of the pawl 140.

Figure 8A:
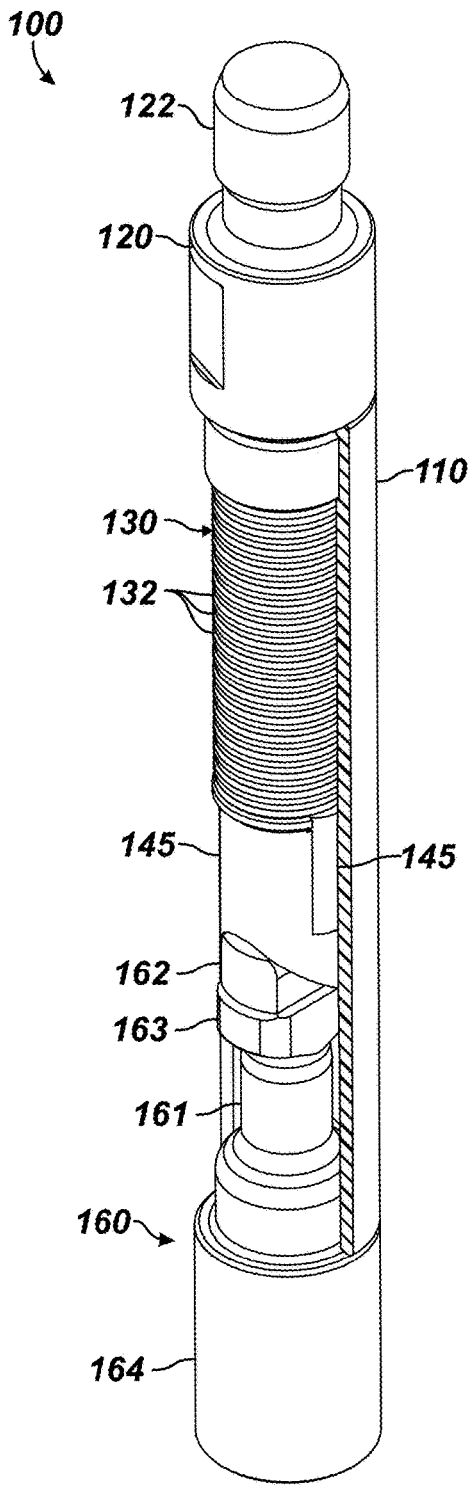
FIG. 8A illustrates a perspective view of the key inserted into the disclosed tool's housing, which is shown in a cutaway to reveal internal features.
Figure 8B:
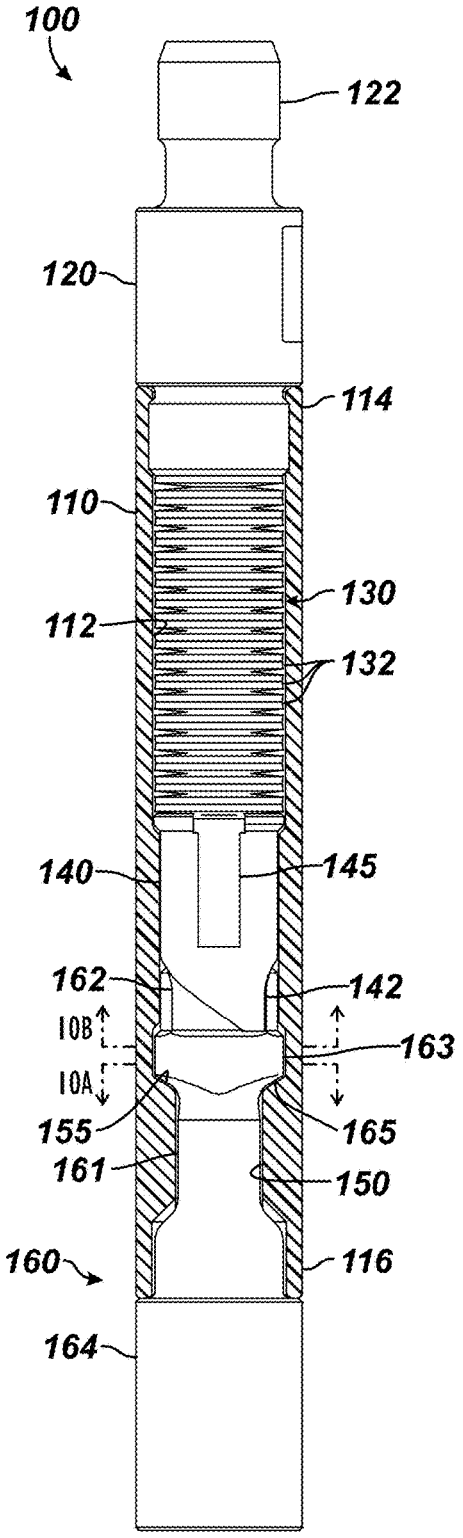
FIG. 8B illustrates an elevational view of the key inserted into the disclosed tool's housing, which is shown in a cutaway.

To complete the latching, the sucker rod (24) is rotated several times at surface to rotate the housing 110 a quarter turn downhole on the key 160. With this quarter turn, the internal cam system of the pawl 140 engages the head 162, and the head 162 locks in the key slot 150. For example, FIG. 8A illustrates a perspective view of the key 160 inserted into the tool's housing 110, which is shown in a cutaway to reveal internal features. FIG. 8B illustrates an elevational view of the key 160 inserted into the tool's housing 110, which is shown in a cutaway.

As noted herein, the pawl 140 is not rotatable in the housing 110 due to the longitudinal pins 145. However, during the latching sequence, the slanted forks 144 on the pawl 144 permit the quarter turn in one direction relative to the engage head 162 so the pawl's pocket 142 can align and fit with the head 162. Therefore, the housing 110 rotated the quarter turn concurrently rotates the pawl 140, and the biasing elements 130 then push the now aligned pawl pocket 142 on the key head 162.

As can be seen, the on-off tool 100 incorporates the cam-type system of the internal pawl 140, which is under the biased force and is actuated (in a longitudinal direction) by rotating relative to the key 160. This imparts torque, which requires the longitudinal guide pins 145 to counteract the torque and to keep the pawl 140 from rotating in the housing 110. The guide pins 145 are oriented to provide maximum contact area relative to the housing 110 and the pawl 140.

During the quarter turn, the key's head 162 engages inside the slot's seat 155. For example, the pawl 140 turns with the housing 110 until the pocket 142 in the pawl 140 aligns with the key's oblong head 162, and the biasing element 130 then pushes the pawl 140 over the head 162. At the same time that the housing 110 turns the pawl 140, the oblong slot 150 in the housing 110 is rotated around the key's stem 161. With this turn, the key's lower bearing surface 165 can be supported on the slot's seat 155, as shown in FIG. 8B, for example.

Now that the housing 110 and the key 160 are latched together, reciprocating of the sucker rod (24) can now operate the pump (30) while the on-off tool 100 holds the sucker rod string (24) to the plunger rod (33) by the engagement of the tool's housing 110 with the key 160. For example, holding the housing 110 and the key 160 longitudinally together during movement or compression can involve the bottom end 116 of the housing 110 engaging the key's base 164, as shown in FIG. 8B. During tension, the lower surface 165 of the key's head 162 is supported by the seat 155 around the slot's expanded diameter headway 153. During movement or compression, the upper surface 166 of the key's waist 163 can be supported by the stop 156 around the slot's expanded diameter headway 153. Finally, the pawl 140 is biased by the spring elements 130 against the key head 162 to push the head's bottom surface 165 toward the slot's seat 155. All of this engaged retention of the key 160 in the slot 150 by the arranged features noted above can help maintain the latching between the housing 110 and key 160 and can further reduce the potential for future wear during operations.

When necessary, unlatching the housing 110 from the key 160 can involve reverse rotation of the housing 110 using the sucker rod string (24). The cam edges on the pawl's forks 144 around the pocket 142 allow the pawl 140 to move off the key head 162 against the bias of the biasing elements 130. This allows the housing 110 to be rotated a quarter turn in the opposite direction relative to the key head 162 so that the head 162 disengages from the slot's seat 155 as the sucker rod string (24) is rotated and pulled. The housing 110 can then be lifted off the key 160 to uncouple the rod string (24) from the pump's plunger (33).

In one aspect of the disclosed tool 100, the biasing element 130 uses disc springs 132 rather than a standard coil spring. The disc springs 132 can be arranged in parallel, in series, or in a combination of these to provide a particular bias force. In an overall, the disc springs 132 are expected to increase the bias force on the pawl 140 by as much as 200% or more in some cases. This increased bias force from the disc springs 132 can in turn help prevent the tool 100 from unlatching accidentally.

Figure 6A:
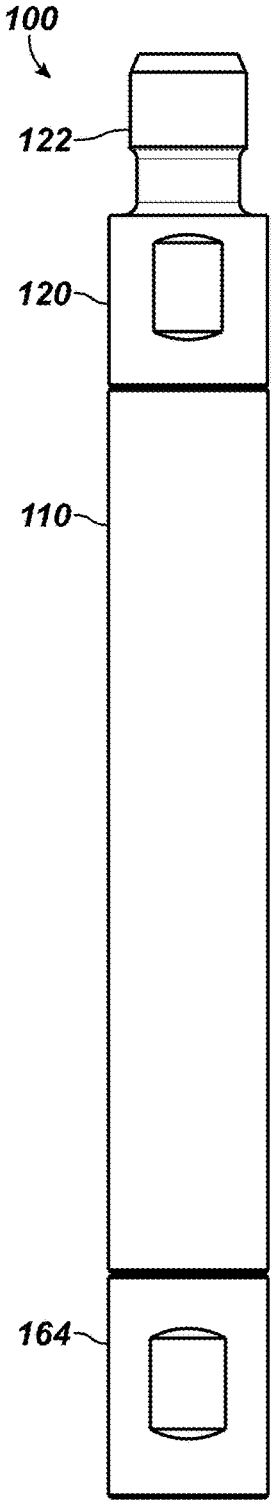
FIG. 6A illustrates an elevational view of an on-off tool according to the present disclosure.
Figure 6B:
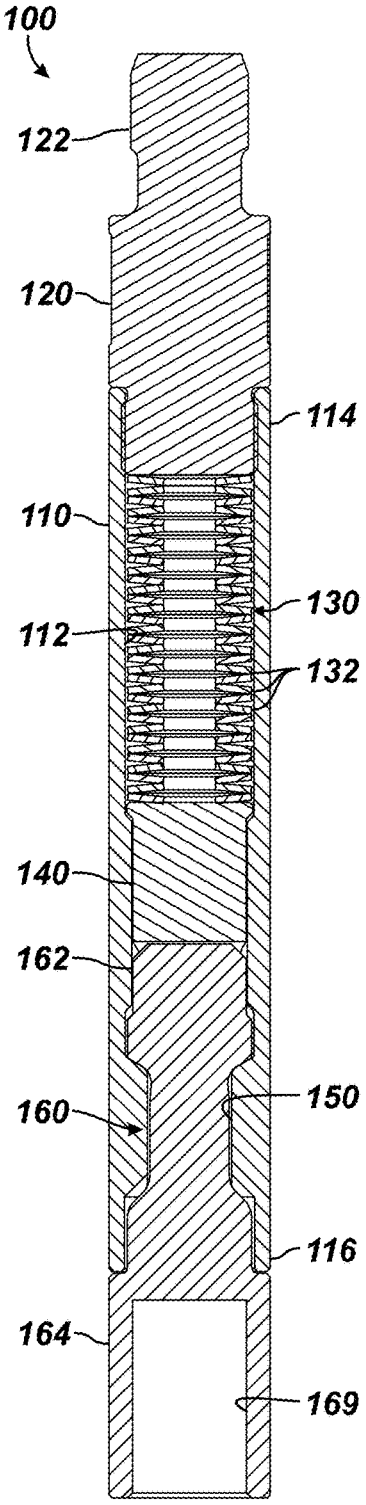
FIGS. 6B-6C illustrate cross-sectional views of the disclosed on-off tool at two different orthogonal sides thereof.
Figure 6C:
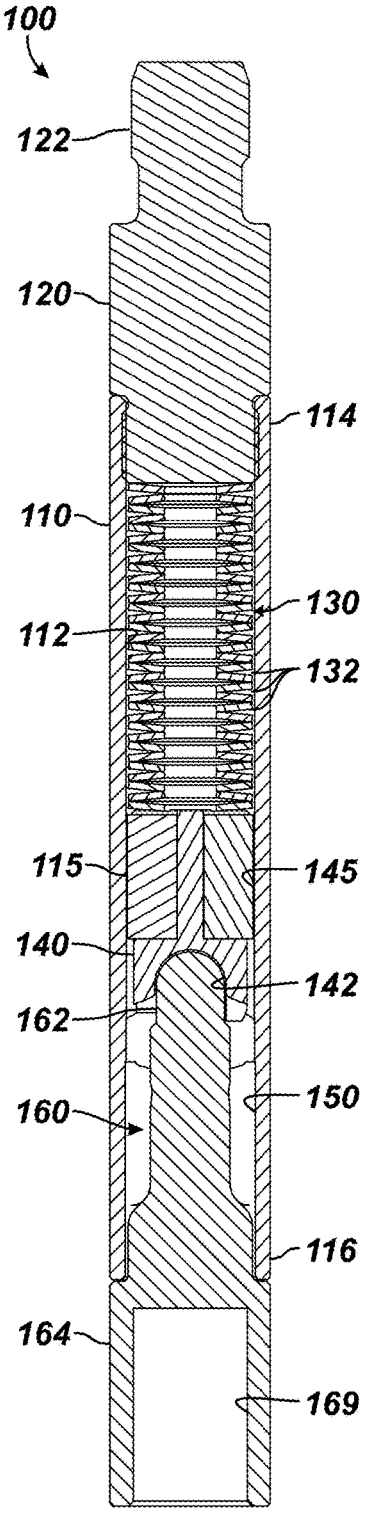
Figures 6D, 6E:
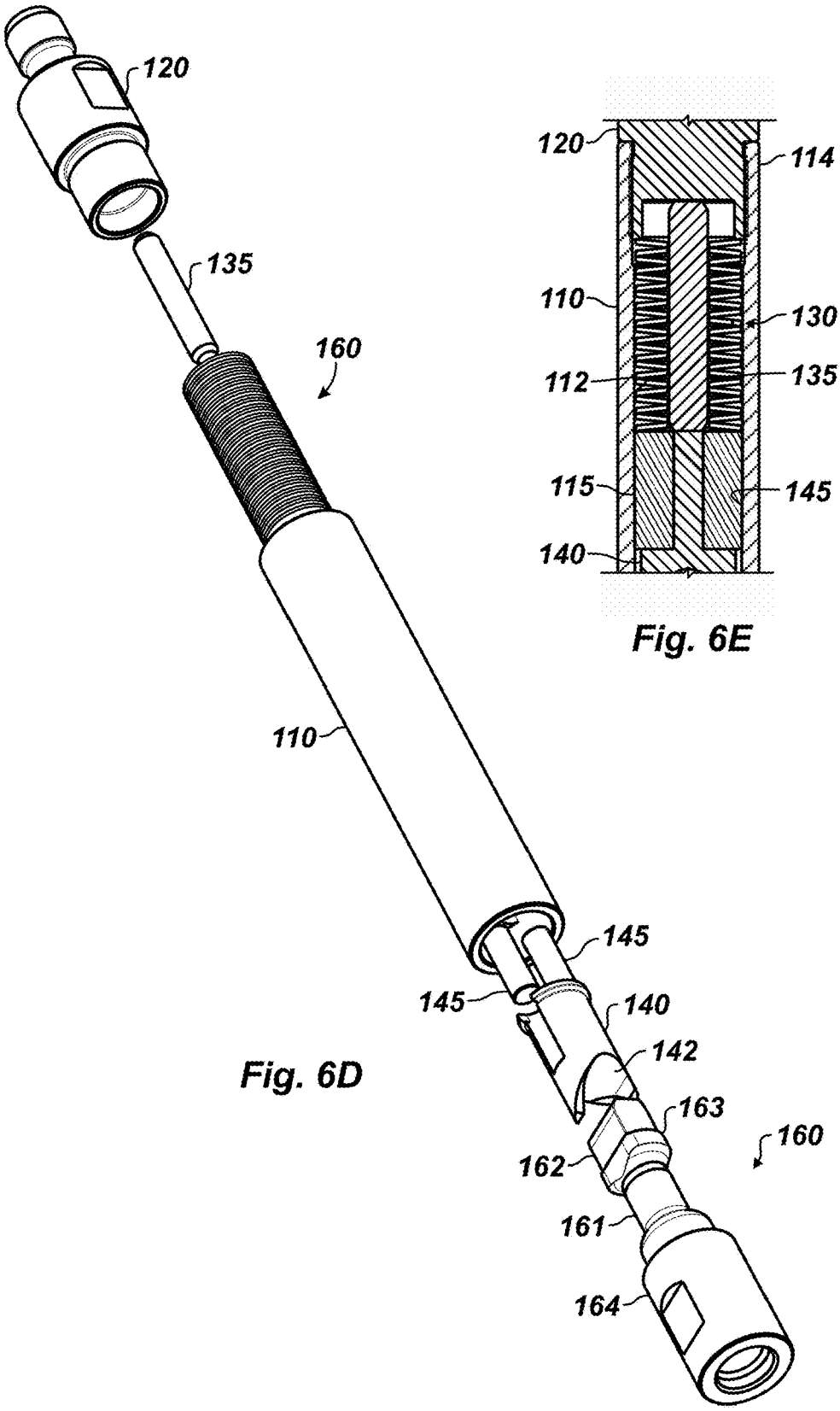
FIG. 6D illustrates an exploded perspective view of the disclosed on-off tool.
FIG. 6E illustrates a detailed cross-sectional view of the tool with a stem for the biasing elements.

The disc springs 132 may be centrally supported about the central pin 135 that can provide a positive stop and an upward limit of the pawl's movement in the housing 110. (For reference, FIG. 6D shows the central pin 135 in the exploded view relative to the disc springs 132, and FIG. 6E illustrates a detailed cross-sectional view of the tool 100 with the central pin 135 for the disc springs 132 for limiting upward movement of the pawl 140.) Use of the pin 135 is not strictly necessary. Instead, the disc springs 132 may be guided by the housing's interior surface 112 and be configured to compress fully to a stacked height that acts as a positive stop and upward limit to the pawl's movement in the housing 110. This cannot be achieved using conventional coil springs of the prior art.

In another aspect that may be combined with any of the other aspects, the pawl 140 is guided and prevented from rotating in the housing interior 112 by at least one of longitudinal guide pins 145 (and preferably the two pins 145 as depicted herein). These guide pins 145 are disposed in longitudinal side pockets of the pawl 140 and can ride in the longitudinal slots 115 along the housing's interior 112. The guide pins 145 positioned vertically in this manner can eliminate point-loading because there is more area in contact while actuating the internal pawl 140. This increased contact area can reduce wear and damage to the internal cam system of the tool 100 during latching and unlatching as well as reciprocating operations.

In yet another aspect that may be combined with any of the other aspects of the disclosed tool 100, the key 160 has increased engagement in the housing 110 to help retain the two in latched relation during reciprocating operations. This increased engagement as noted herein can reduce wear and potential damage.

Figure 9A:
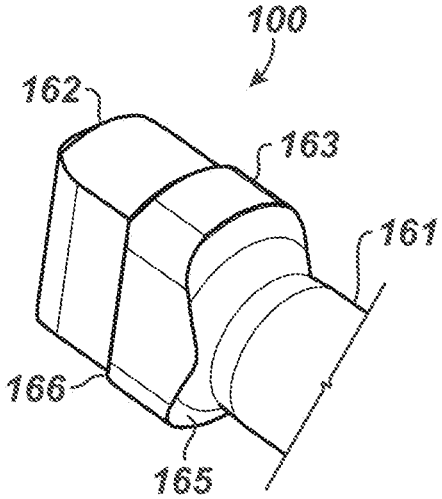
FIG. 9A illustrates a perspective view of a key head according to the present disclosure.
Figure 5C:
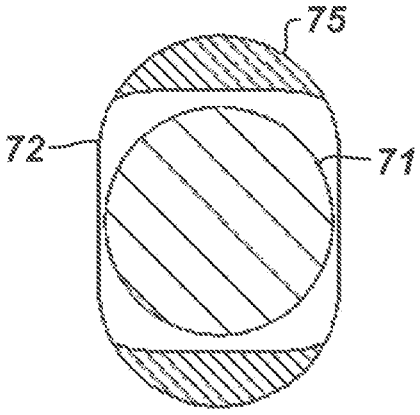
Fig. 5C (Prior Art)
FIG. 5C illustrates a diagram of the load bearing areas of the prior art key head.
Figure 5D:
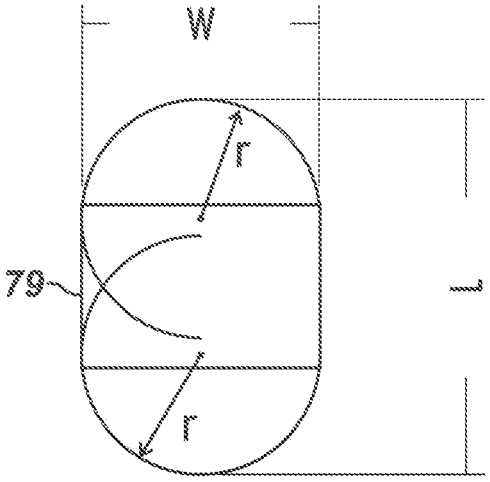
Fig. 5D (Prior Art)
FIG. 5D illustrates the geometry of the key's head of the prior art.

In particular, the head 162 of the key 160 defines the waist 163 of increased dimension, as already alluded to above. For further reference, FIG. 9A illustrates a perspective view of the key head 162 showing additional details. The waist 163 straddles around the lower end of the head 162 near the key's stem 161. The tip beyond the waist 163 has thinned sides so that the distal end of the head 162 can still sufficiently engage with the pocket (142) of the pawl (140). By contrast, the waist 163 produces an increased load bearing surface 165 around the key's stem 161 for engaging against the seat (155) of the housing (110). Furthermore, the waist 163 produces an upper bearing surface 166 for potentially engaging against the stop (156) of the housing (110), if desired.

Figures 1, 5A:
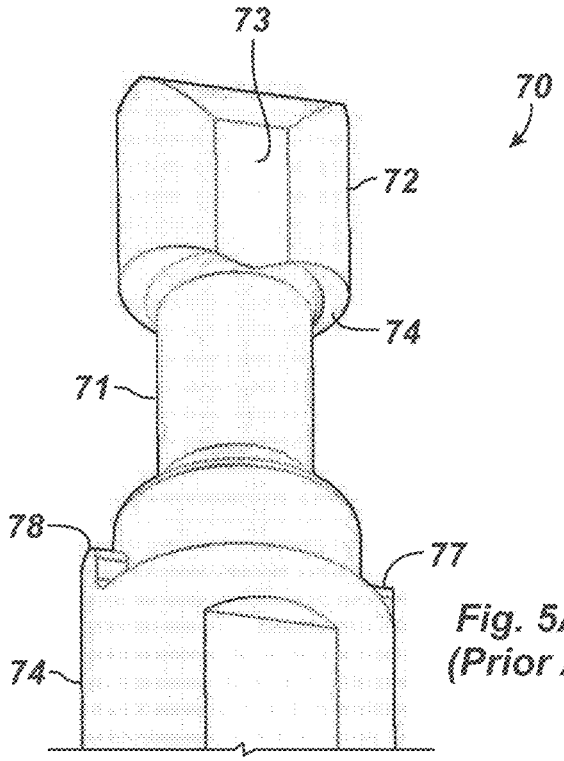
Fig. 5A-1 (Prior Art)
Figure 5B:
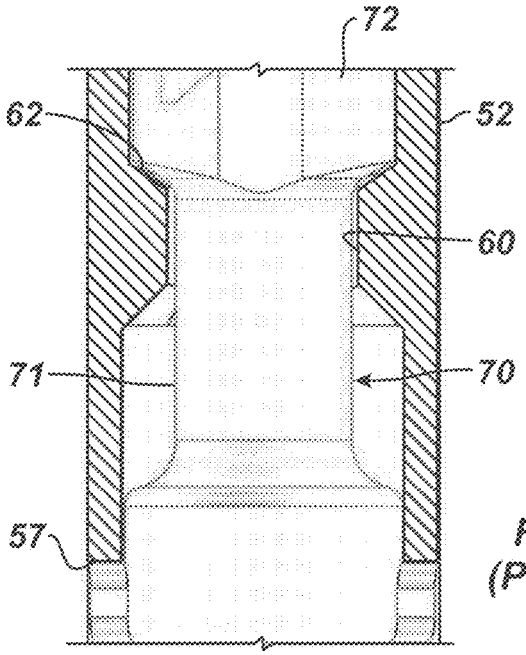
Fig. 5B (Prior Art)
FIG. 5B shows the key head of the prior art tool seated in the tool housing.
Figures 2, 5A:
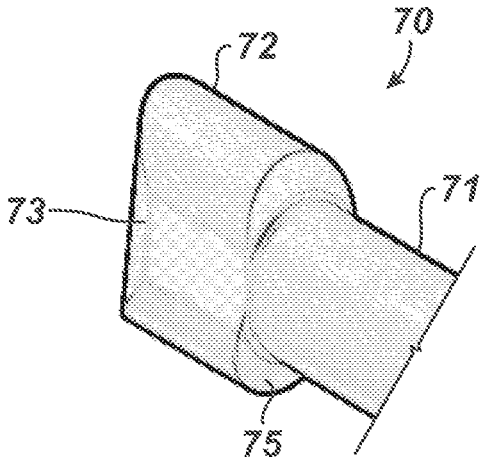
Fig. 5A-2 (Prior Art)

These features highlight a marked difference to the conventional head (72) of a prior art key (70), as discussed previously with reference to FIG. 5A. In addition to these differences, the head 162 of the disclosed key 160 can define a larger radius where it connects to the stem 161, which can reduce fatigue and failure. This larger radius between the head 162 and stem 161 can also be polished to remove machining marks and lines that may be left during manufacture. This too can improve the resistance to fatigue. Finally, the overall height of the head 162 may be greater than conventionally used. In the end, these and other improvements can be made to the key 160.

Figure 9B:
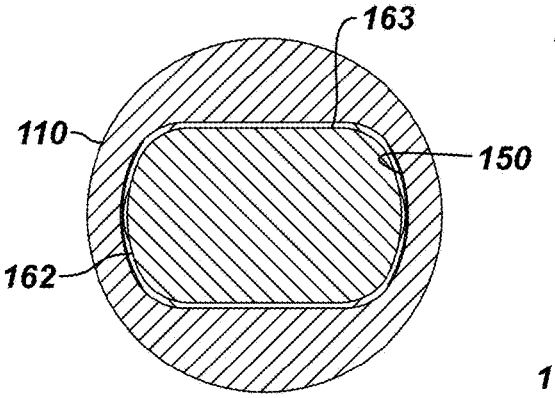
FIG. 9B illustrates, in an end-section, passage of the key head into the housing's slot.

More significantly, the increased bearing surfaces 165 of the head 162 produced by the waist 163 offers a number of advantages to reduce wear and potential damage during reciprocating operations. Turning first to FIG. 9B, the key head 162 with its waist 163 is illustrated in an end-section passing through the oblong slot 150 of the housing 110. As can be seen, the overall outer shape of the key's waist 163 is rectangular and closely matches the shape of the housing's oblong slot 150. This allows the head 162 and waist 163 to have more surface, while still being able to insert through the slot 150 when matched up thereto. To avoid sharp edges that could cause scraping and the like, the rectangular corners of the waist 163 and slot 150 are rounded, as will be described below.

Figure 9C:
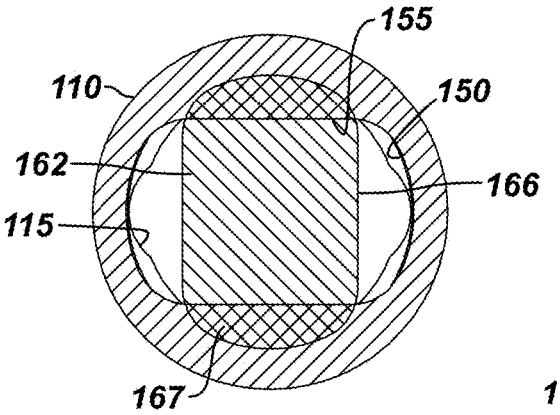
FIG. 9C diagrammatically illustrates, in an end-section, contact surfaces between the key head and the seat in the housing's slot.

When the housing 110 and key 160 are rotated the quarter turn relative to one another, then the rectangular head 162 of the key 160 with its waist 163 orients orthogonally to the rectangular slot 150. This produces an increased amount of contact area for the head's lower surface to engage the slots seat (155). As an example, FIG. 9C diagrammatically illustrates, in an end-section looking up through the tool. The contact area 167 available between the key's head 162 and waist 163 with the seat 155 in the slot 150 of the housing 110 is diagrammed in cross-hatched lines. The head 162 of the key (160) is shown rotated at about 90-degrees from the slot 150 and has approximately 20% more contact area than currently available in prior art arrangements. The increase load bearing surface 165 on the head 162 produced by the waist 163 can decrease both bearing stress and stress concentrations on the key 160.

Figure 10A:
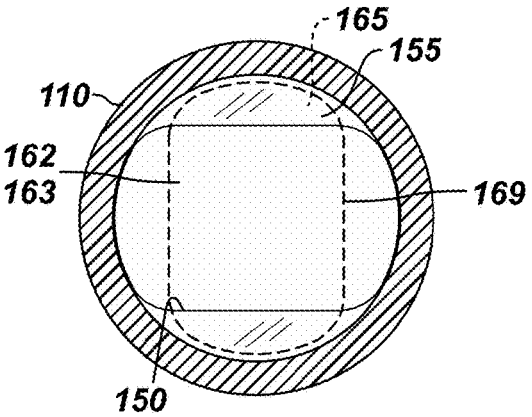
FIG. 10A illustrates an outline of the head's waist relative to the seat in the housing's slot.

To further show how the key's head 162 and specifically the bearing surface 165 engage the seat 155 of the slot 150, FIG. 10A illustrates an outline 169 of the head's waist (163) looking downward relative to the seat 155 in the slot 150 of the housing 110. The head (162) is shown turned in its engaged position so that the bottom contact surfaces of the head and waist (162 and 163) can engage the seat 155 when the housing 110 and key 160 attempt to move apart during operation.

Figure 10B:
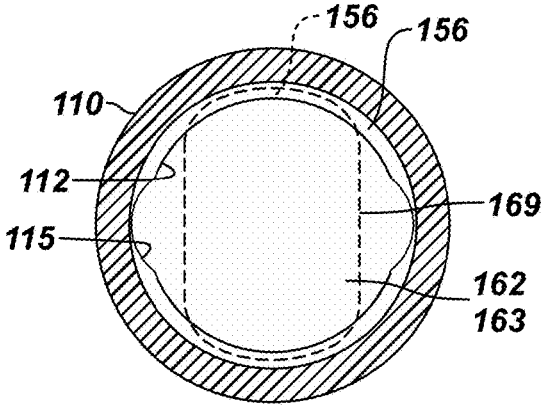
FIG. 10B illustrates an outline of the head's waist relative to the upper ledge in the housing's slot.

In the reverse direction, FIG. 10B illustrates the outline 169 of the head's head and waist (162 and 163) looking upward relative to the upper ledge 156 in the slot 150 of the housing 110. The head (162) is again shown turned in its engaged position. The upper contact surface (166) of the waist (163) can engage the upper stop 156 when the housing 110 and the key 160 attempt to move together during operation.

Figure 11:
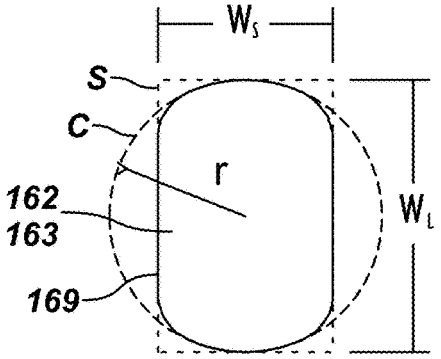
FIG. 11 illustrates the geometry of the key head's waist.

Finally, FIG. 11 illustrates the geometry of the key's head and waist (162 and 163) as an outline 169. As can be seen, the outline 169 is oblong and generally defines a rectangular shape S with long sides $W_L$ and short sides $W_S$. Edges at the short sides $W_S$ are truncated by a radius R of a full circle so the head's waist 163 can fit neatly into the cylindrical contours associated with the housing (110), interior (112), increased dimension headway (153), key slot (150), and other features of the disclosed tool (100). In general, manufacture of the key's head 162 to have the desired outline 169 can involve starting with a cylindrical element having a radius R and then removing parallel long sides $W_L$ therefrom. The resulting corners can then be rounded slightly as desired.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A tool for latching a sucker rod to a plunger, the tool comprising:

a housing having first and seconds ends and defining an interior, the interior defining at least one longitudinal slot, the first end connecting to the sucker rod, the interior defining a key slot at the second end of the housing, the key slot terminating at a seat inside the interior;

a pawl disposed in the interior of the housing and biased longitudinally therein away from the first end toward the seat, the pawl defining a longitudinal side pocket;

at least one bearing being an elongate pin and being engaged between the longitudinal side pocket of the pawl and longitudinal slot of the housing, the at least one pin guiding longitudinal movement of the pawl in the interior and preventing rotation of the pawl in the interior; and a key having distal and proximal ends, the proximal end connecting to the plunger, the distal end having a head extending on a stem from the proximal end, the head passable through the key slot, interlockable with the pawl, and seatable on the seat.

2. The tool of claim 1, wherein the housing comprises at least one biasing element disposed in the interior and basing the pawl longitudinally therein away from the first end.

3. The tool of claim 2, wherein the at least one biasing element comprises a plurality of disc springs.

4. The tool of claim 2, further comprising a lug disposed in the interior and engageable between the first end of the housing and the pawl, the lug limiting the longitudinal movement of the pawl in the housing toward the first end.

5. The tool of claim 1, wherein the pawl defines opposing ones of the longitudinal side pocket, wherein the housing defines opposing ones of the longitudinal slot in the interior, and wherein the at least one bearing comprises at least two of the elongate pins being disposed in the opposing side pockets of the pawl and in the longitudinal slots of the interior.

6. The tool of claim 1, wherein the pawl comprises forks on both sides of the pocket, the forks defining edges slanted in opposing directions and engageable with the head.

7. The tool of claim 1, wherein the housing defines an inner shoulder; and wherein the pawl defines an outer shoulder, the inner shoulder engageable with the outer shoulder and limiting the longitudinal movement of the pawl toward the second end of the housing.

8. The tool of claim 1, wherein the key comprises a shoulder disposed about the stem, and wherein the second end of the housing is engageable with the shoulder.

9. The tool of claim 1, wherein the head of the key defines a first outer dimension greater than a second outer dimension of the stem, and wherein the head comprises a waist with a third outer dimension greater than the first outer dimension of the head.

10. The tool of claim 9, wherein the third outer dimension of the waist is rectangular with long sides and short sides, the short sides curved according to a circular profile.

11. The tool of claim 10, wherein the key slot defines a keyway defining a profile approximate to the third outer dimension of the waist.

12. The tool of claim 9, wherein the waist defines a lower contact area of a lower bearing surface of the key to engage on the seat in the housing.

13. The tool of claim 9, wherein the head toward the distal end defines a tip beyond the waist, the tip having the first outer dimension with thinned sides to engage in the pocket of the pawl.

14. The tool of claim 13, wherein the head defines an upper contact area between the first dimension of the tip and the third dimension of the waist and defines a lower contact area between the third dimension of the waist and the second dimension of the stem.

15. The tool of claim 14, wherein the key slot of the housing defines a headway in which the head positions, the headway having the seat as a lower shoulder engageable with the lower contact area of the head, the headway having an upper shoulder engageable with the upper contact area of the head.

16. The tool of claim 15, wherein the headway defines a circular dimension in the interior of the housing.

17. A tool for latching a sucker rod to a plunger, the tool comprising:

a housing having first and seconds ends and defining an interior, the first end connecting to the sucker rod, the interior defining a key slot at the second end of the housing, the key slot terminating at a seat inside the interior;

a pawl disposed in the interior of the housing and biased longitudinally therein away from the first end toward the seat;

at least one bearing engaged between the pawl and the housing, the at least one bearing guiding longitudinal movement of the pawl in the interior and preventing rotation of the pawl in the interior; and a key having distal and proximal ends, the proximal end connecting to the plunger, the distal end having a head extending on a stem from the proximal end, the head passable through the key slot and interlockable with the pawl, the head having a waist seatable on the seat, wherein the head of the key defines a first outer dimension greater than a second outer dimension of the stem, and wherein the waist of the head has a third outer dimension greater than the first outer dimension of the head.

18. The tool of claim 17, wherein the waist with the third outer dimension provides a seating area seatable on the seat greater than the first outer dimension of the head.

19. The tool of claim 17, further comprising a plurality of disc springs disposed in the interior and biasing the pawl longitudinally therein away from the first end.

20. The tool of claim 19, further comprising a lug disposed in the interior through the plurality of disc springs and engageable between the first end of the housing and the pawl, the lug limiting the longitudinal movement of the pawl in the housing toward the first end.

21. The tool of claim 17, wherein the third outer dimension of the waist is rectangular with long sides and short sides, the short sides curved according to a circular profile.

22. The tool of claim 17, wherein the head toward the distal end defines a tip beyond the waist, the tip having the first outer dimension with thinned sides to engage in the pocket of the pawl.

23. The tool of claim 17, wherein the waist defines an upper contact area between the first dimension of the head and the third dimension of the waist and defines a lower contact area between the third dimension of the waist and the second dimension of the stem.

24. The tool of claim 23, wherein the key slot of the housing defines a headway in which the head positions, the headway having the seat as a lower shoulder engageable with the lower contact area of the waist, the headway having an upper shoulder engageable with the upper contact area of the waist.

25. The tool of claim 24, wherein the headway defines a circular dimension in the interior of the housing.

* * * * *